US006267389B1

(12) United States Patent
Veltmeyer

(10) Patent No.: US 6,267,389 B1
(45) Date of Patent: Jul. 31, 2001

(54) SKATE WITH TILTABLE FOOT SUPPORT

(76) Inventor: James D. Veltmeyer, 3948 Pacheco Rd., San Diego, CA (US) 92111

( * ) Notice: Subject to any disclaimer, the term of this patent is extended or adjusted under 35 U.S.C. 154(b) by 0 days.

(21) Appl. No.: 09/118,899

(22) Filed: Jul. 20, 1998

(51) Int. Cl.[7] ..... A63C 17/04

(52) U.S. Cl. ..... 280/11.224; 280/11.221; 280/11.225

(58) Field of Search ..... 280/11.22, 11.27, 280/11.28, 11.21, 11.19, 11.115, 11.14, 11.26, 11.221, 11.224, 11.225

(56) References Cited

U.S. PATENT DOCUMENTS

| | | | | |
|---|---|---|---|---|
| Re. 35,993 | | 12/1998 | Gierveld | 280/11.22 |
| 5,441,286 | * | 8/1995 | Pozzobon | 280/11.27 |
| 5,503,413 | * | 4/1996 | Belogour | 280/11.22 |
| 5,586,774 | * | 12/1996 | Dentale | 280/11.22 |
| 5,634,648 | * | 6/1997 | Tonel et al. | 280/11.22 |
| 5,823,543 | * | 10/1998 | Burns et al. | 280/11.22 |
| 5,842,706 | * | 12/1998 | Chang | 280/11.28 |
| 5,890,724 | * | 4/1999 | Gignoux et al. | 280/11.28 |
| 5,979,916 | * | 11/1999 | Gatel et al. | 280/11.22 |

FOREIGN PATENT DOCUMENTS

| | | | | |
|---|---|---|---|---|
| 277009 | * | 3/1915 | (DE) | 280/11.27 |
| 1203650 | * | 10/1965 | (DE) | 280/11.19 |
| 2029676 | * | 5/1979 | (DE) . | |
| 2556228 | * | 6/1985 | (FR) | 280/11.19 |

* cited by examiner

*Primary Examiner*—Brian L. Johnson
*Assistant Examiner*—Deanna Draper
(74) *Attorney, Agent, or Firm*—Henri J. A. Charmasson; John D. Buchaca

(57) ABSTRACT

A skate particularly adapted for speed contests has a foot-receiving boot hinged about a fore-foot section of the sole to a in-line wheel-mounting or blade-mounting truck so that the heel-section of the boot can be rotatively lifted away from the truck while keeping the skate is full contact with the skating surface. The boot is biased down toward the truck by a strong spring in a first embodiment of the invention, or by the resiliency of a hinge-forming web linking the boot to the truck in an alternate embodiment. A quickly set mechanism is provided to lock the boot onto the truck to turn the device into a conventional skate.

15 Claims, 1 Drawing Sheet

SKATE WITH TILTABLE FOOT SUPPORT

FIELD OF THE INVENTION

This invention relates to roller skates as well as ice skates, and more particularly to skates used in speed contests.

BACKGROUND OF THE INVENTION

In the course of a skating speed contest, it is advantageous at times to increase the angular position of the feet in relationship to the skating surface by raising the heel. When using the prior art skates the above maneuver reduces the amount of contact between the skate and the skating surface. This in turn may reduce traction and the amount of driving force that the skater can apply to the skates.

SUMMARY OF THE INVENTION

The primary and secondary objects of the invention are to provide a new type of skates in which the angular relationship between the foot-receiving upper part of the skate and the part in contact with the skating surface, whether the latter is a roller assembly or a blade, can be varied at will or locked into a standard position.

These and other valuable objects are achieved by a skate in which the fore-foot section of the boot or foot rest is hinged to the ground-contacting assembly, and the foot is constantly urged towards a common, traditional flat position by a spring whose bias can easily be overcome by the skater to raise the heel as may be more advantageous under certain conditions. The foot-holding and ground-contacting assemblies can also be locked.

DESCRIPTION OF THE PREFERRED EMBODIMENT OF THE INVENTION

Figures 1, 2, 3, 4, 5, 6:
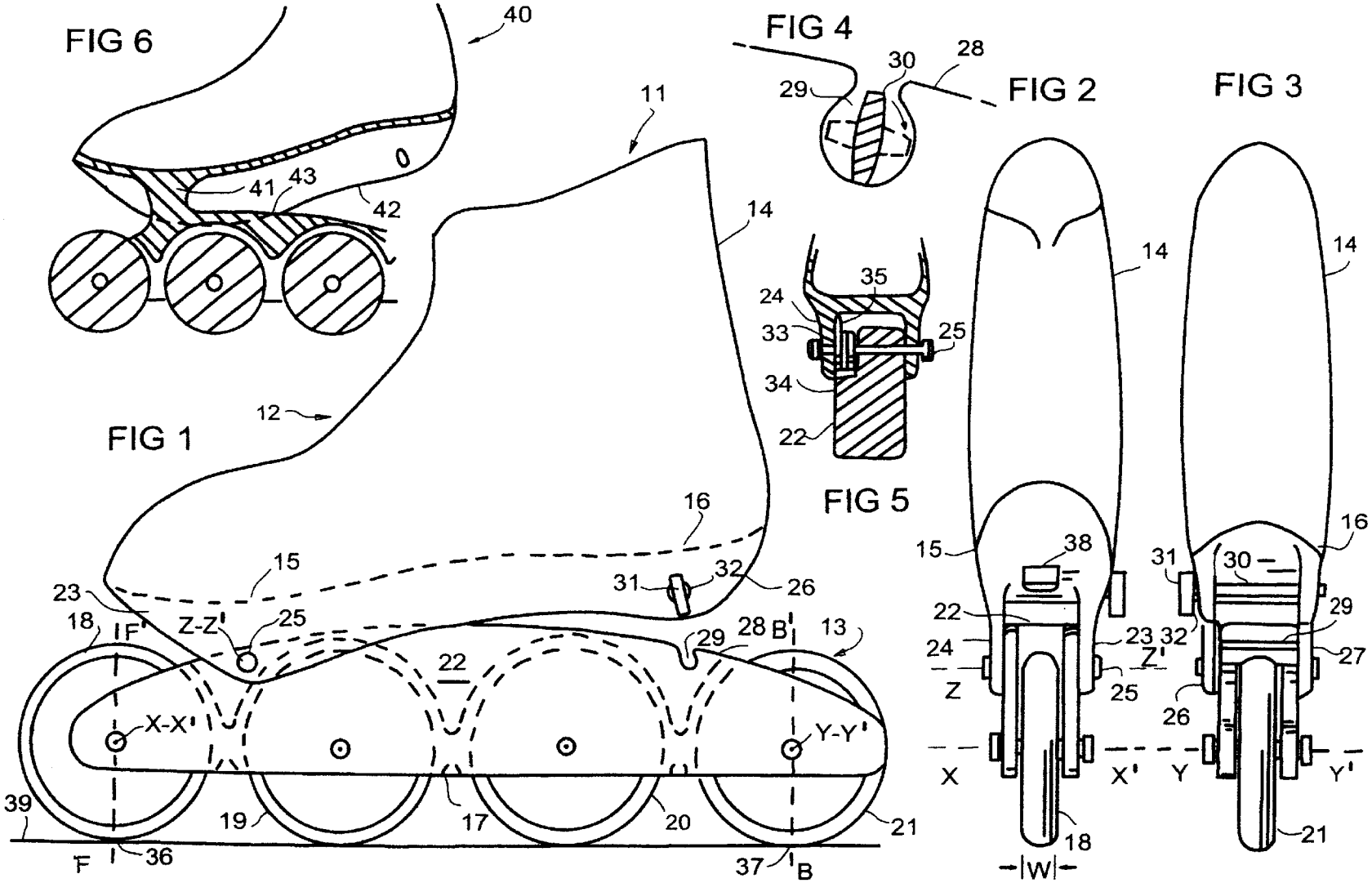
FIG. 1 is a left side view of a left foot roller skate assembly according to the invention.
FIG. 2 is a front view thereof.
FIG. 3 is a back view thereof.
FIG. 4 is a cross-sectional view of the locking spindle.
FIG. 5 is a cross-sectional view of the biasing mechanism.
FIG. 6 is a partial, longitudinal cross-sectional view of an alternate embodiment of the invention.

Referring now to the drawing, there is shown FIGS. 1–5 a left foot roller skate 11 which comprises a foot-receiving assembly 12, and a ground-contacting assembly 13. The foot-receiving assembly includes a boot 14 having a fore-foot section 15 and a heel section 16. The ground-contacting assembly includes a frame or truck 17 mounting a low-friction ground support structure, in this case, a set of four in-line rollers 18, 19, 20, and 21. The low-friction ground support structure could alternately consist of an ice skate blade. Projecting upwardly from the truck is a mounting head 22 for the foot-receiving assembly 12. Projecting downwardly from the fore-foot section 15 of the boot and astride the truck head are a pair of parallely spaced-apart gusset-like blades 23, 24. A pin 25 lying along a transversal axis Z–Z' interconnects the blades and the truck head. The foot-receiving assembly 12 is thus hinged to the ground-contacting assembly 13, allowing the heel section 16 to rotate away from the truck head 22.

A second pair of gusset-like blades 26, 27 project downwardly from the heel section, and rest astride the back section 28 of the truck head when the heel section is down to its lowermost position against the truck head. In that position, a key-hole shaped groove 29 cut transversally across the top surface of the truck head is dimensioned and positioned to receive a flattened spline 30 that spans the heel blades 26, 27 and is rotatively mounted thereto. As more specifically illustrated in FIG. 4, when the spline is rotated by means of end knob 31 about 90 degrees, the heel section is locked into the truck head. The spline retains its locked or opened position through friction mounting to the heel blades. Alternatively, a coil spring 32 is preferably wound around the spline shaft to bias the spline toward the locked position. A similar but stronger coil spring 33 is wound around the pin 25 as illustrated in FIG. 5 to bias the heel section 22 toward the truck head. One end 34 of the spring connects to the truck head while the opposite end 35 connects to the fore-foot section. Depending upon the weight and physical strength of the wearer, the force of the coil spring may range between about 10 to 25 kilograms (20 to 50 lbs) so that the force may be overcome through the power stroke of the skater but allow a snapping-back into the closed position during the recovery stroke.

The hinging axis Z–Z' lies between two vertical lines F–F', B–B', that intercept the most forwardly positioned 36 and the most rearwardly located 37 ground contact points of the ground contacting assembly respectively, and also in this case the axes X–X' and Y–Y' front and back rollers.

For maximum lateral stability, the two pairs of blades 23, 24 and the boot, and are joined together along each lateral edge of the foot-receiving assembly.

An aperture 38 cut into the toe section of the boot has the same width W as the front wheel 18 allowing the wearer to sense there through that the angular lift of the heel section has reached its maximum excursion. Thus providing a warning that any further lifting of the heel could cause the back section of the ground-contacting assembly to loose contact with the skating surface 39.

The size and location of the aperture can be selected to indicate to the skater via touch the proper moment when to terminate the power stroke.

In the alternate embodiment of the invention 40 illustrated in FIG. 6, the hinging mechanism consists of a thick web 41 of synthetic material manufactured integrally with the boot sole just like gusset-like blade structures 42 that remain unchanged.

The web can also be integral with the truck head 43 or fastened to it. The sole purpose of the blade structures in this case is to provide lateral stability as they closely ride along the sides of the truck head 43. The resiliency of the web provide the upward bias of the mechanism. Excluding the hinging feature, all the other features of the previously described embodiment are present.

While the preferred embodiments of the invention have been described, modifications can be made and other embodiments may be devised without departing from the spirit of the invention and the scope of the appended claims.

What is claimed is:

1. A skating apparatus which comprises:

a ground-contacting assembly including a low-friction structure for supporting contact with a ground surface;

a foot-supporting assembly mounted upon said ground-contacting assembly and including a foot-receiving structure having a fore-foot section and a heel section;

means for hingedly connecting said foot-supporting assembly to said ground-contacting assembly about said fore foot section; and means for resiliently biasing said heel section toward said ground-contacting assembly;

wherein said low-friction structure comprises a plurality of ground contacting points including a most forwardly located point and a most rearwardly located point;

wherein said means for hingedly connecting has a pivoting axis located between vertical lines respectively passing through said most forwardly located point and most rearwardly located point; and wherein said means for hingedly connecting comprise a web of resiliently flexible synthetic material joining said fore-foot section to said ground-contacting assembly.

2. The apparatus of claim 1, wherein said web is integrally formed with said foot-receiving assembly.

3. The apparatus of claim 1, wherein said web is integrally formed with part of said ground-contacting assembly.

4. The apparatus of claim 1 which further comprises means for detachably securing said heel section to said ground-contacting assembly.

5. The apparatus of claim 1 which further comprises means for indicating to a user that said heel section has been lifted away from said ground-contacting assembly to an angular position corresponding to the extent of a power stroke.

6. The apparatus of claim 1, wherein said low-friction structure comprises:

an elongated truck; and a plurality of ground-contacting rollers rotatively connected in line to said truck about rotating axes parallel to said pivoting axis including a most forwardly-located roller having a given width.

7. The apparatus of claim 6, wherein said fore-foot section has a forwardly-located groove aligned with said most forwardly-located roller and commensurate with said width;

whereby said roller penetrates said slot when said heel section is lifted away from said ground-contacting assembly to a maximum angular position.

8. A skating apparatus which comprises:

a ground-contacting assembly including a low-friction structure for supporting contact with a ground surface;

a foot-supporting assembly mounted upon said ground-contacting assembly and including a foot-receiving structure having a fore-foot section and a heel section:

means for hingedly connecting said foot-supporting assembly to said ground-contacting assembly about said fore-foot section; and means for resiliently biasing said heel section toward said ground-contacting assembly at all angular positions between said foot-supporting assembly and said ground-contacting assembly;

wherein said low-friction structure comprises a plurality of ground-contacting points including a most forwardly located point and a most rearwardly located point; and said means for hingedly connecting has a pivoting axis located between vertical lines respectively passing through said most forwardly located point and most rearwardly located point;

wherein said means for hingedly connecting comprise:

a head extending upwardly from said ground-contacting assembly;

a pair of parallelly spaced-apart blades extending downwardly from said fore-foot section astride said head; and means for pivotally joining said head to said pair of blades about said pivoting axis;

wherein said means for resiliently biasing comprise a coil spring wound about said pivoting axis, and having a first end connected to said fore-foot section and a second, opposite end connected to said ground-contacting assembly.

9. The apparatus of claim 8, which further comprises means for detachably securing said heel section to said ground-contacting assembly.

10. The apparatus of claim 8, which further comprises means for indicating to a user that said heel section has been lifted away from said ground-contacting assembly to an angular position corresponding to the extent of a power-stroke.

11. The apparatus of claim 8, wherein said low-friction structure comprises:

an elongated truck; and a plurality of ground-contacting rollers rotatively connected in line to said truck about rotating axes parallel to said pivoting axis including a most forwardly-located roller having a given width.

12. The apparatus of claim 11, wherein said fore-foot section has a forwardly-located groove aligned with said most forwardly-located roller and commensurate with said width;

whereby said roller penetrates said slot when said heel section is lifted away from said ground-contacting assembly to a maximum angular position.

13. A skating apparatus which comprises:

a ground-contacting assembly including a low-friction structure for supporting contact with a ground surface;

a foot-supporting assembly mounted upon said ground-contacting assembly and including a foot-receiving structure having a fore-foot section and a heel section;

means for hingedly connecting said foot-supporting assembly to said ground-contacting assembly about said fore-foot section; and means for resiliently biasing said heel section toward said ground-contacting assembly at all angular positions between said foot-supporting assembly and said ground-contacting assembly;

wherein said low-friction structure comprises a plurality of ground-contacting points including a most forwardly located point and a most rearwardly located point; and said means for hingedly connecting has a pivoting axis located between vertical lines respectively passing through said most forwardly located point and most rearwardly located point;

wherein said means for hingedly connecting comprise a web of resiliently flexible synthetic material joining said fore-foot section to said ground-contacting assembly.

14. The apparatus of claim 13, wherein said web is integrally formed with said foot-receiving assembly.

15. The apparatus of claim 13, wherein said web is integrally formed with part of said ground-contacting assembly.

* * * * *